US005713650A

United States Patent [19]

King et al.

[11] Patent Number: 5,713,650

[45] Date of Patent: Feb. 3, 1998

[54] FURNITURE INCLUDING SECURITY CONTAINER

[76] Inventors: Andrew Curtis King, 816 N. Castle Heights Dr.; John Brian Wing, 288 N. 1230 West (P.O. Box 1104), both of Price, Utah 84501

[21] Appl. No.: 253,061

[22] Filed: Jun. 2, 1994

[51] Int. Cl.[6] ..... A47B 83/00; A47B 87/00

[52] U.S. Cl. ..... 312/265.4; 5/2.1; 312/321.5; 70/63

[58] Field of Search ..... 312/265.4, 237, 312/240; 5/5.1, 2.1, 9.1, 931; 70/63, 67; 109/19, 59, 63, 1 V, 22, 23, 30, 53, 55, 56, 68, 78; 49/169–171

[56] References Cited

U.S. PATENT DOCUMENTS

| | | | |
|---|---|---|---|
| D. 118,982 | 2/1940 | Mash et al. . | |
| 152,357 | 6/1874 | French . | |
| 550,717 | 12/1895 | Hallenbeck | 109/1 V |
| 1,003,878 | 9/1911 | Cooper | 109/53 X |
| 1,209,080 | 12/1916 | Tower | 312/405.1 X |
| 1,984,977 | 12/1934 | Mize | 312/321.5 X |
| 2,046,909 | 7/1936 | Terry et al. | 312/321.5 X |
| 2,462,524 | 10/1949 | Mattedi . | |
| 3,058,123 | 10/1962 | Pink et al. | 5/2.1 |
| 3,070,046 | 12/1962 | Paulos | 109/59 X |
| 3,148,385 | 9/1964 | Kamp | 5/2.1 X |
| 3,325,233 | 6/1967 | Oppenhuizen et al. | 5/2.1 X |
| 3,389,410 | 6/1968 | Weigel | 5/2.1 X |
| 3,559,429 | 2/1971 | Hermann | 70/53 |
| 3,587,486 | 6/1971 | Heinrichs | 109/23 X |
| 3,647,274 | 3/1972 | Schnelle | 312/257.1 |
| 3,745,596 | 7/1973 | Copeland | 5/308 |
| 3,952,342 | 4/1976 | Hart | 5/2.1 |
| 3,995,334 | 12/1976 | Harris | 5/202 |
| 4,109,328 | 8/1978 | Mason | 5/2.1 |
| 4,110,854 | 9/1978 | Sjolie | 5/2.1 |
| 4,139,077 | 2/1979 | Pena, Jr. | 312/237 X |
| 4,139,916 | 2/1979 | Alford, Sr. | 5/2.1 |
| 4,232,411 | 11/1980 | Speyer | 5/2.1 X |
| 4,237,563 | 12/1980 | Ollerman | 5/2.1 |
| 4,253,204 | 3/1981 | Tasaka | 5/2.1 |
| 4,312,086 | 1/1982 | Bianco | 5/9.1 X |
| 4,368,622 | 1/1983 | Brooks | 62/447 X |
| 4,613,999 | 9/1986 | Franco et al. | 5/400 |
| 4,741,275 | 5/1988 | Lewiner et al. | 109/59 R X |
| 4,788,838 | 12/1988 | Cislo | 70/63 X |
| 4,800,822 | 1/1989 | Adkins | 109/19 |
| 4,807,315 | 2/1989 | Wachenheim | 5/2.1 X |
| 4,869,449 | 9/1989 | Goodman | 5/308 X |
| 4,888,838 | 12/1989 | Pelski | 5/207 |
| 5,056,342 | 10/1991 | Prinz | 70/63 |
| 5,194,039 | 3/1993 | Hellman, Jr. | 109/1 V X |
| 5,317,888 | 6/1994 | Towns | 70/63 |

FOREIGN PATENT DOCUMENTS

| | | | |
|---|---|---|---|
| 2532402 | 3/1984 | France | 312/265.4 |
| 196815 | 5/1923 | United Kingdom | 109/68 |

*Primary Examiner*—James R. Brittain
*Assistant Examiner*—Robert J. Sandy
*Attorney, Agent, or Firm*—Watson Cole Stevens Davis, PLLC

[57] ABSTRACT

Furniture units such as beds, sofas, wall units, modular furniture, including bookcase/desk combinations, as well as other combinations of the furniture units with a secure container or safe are disclosed. The framework of the furniture is formed of steel, welded or otherwise fastened, into an integral unit so as to house the safe within a cage of steel. The safe may be attached to the framework by a bolt or a lock not otherwise accessible from outside the interior of the safe.

20 Claims, 7 Drawing Sheets

FURNITURE INCLUDING SECURITY CONTAINER

BACKGROUND OF THE INVENTION

1. Field of the Invention

The present invention is directed to a storage unit whereby valuables can be safely stored while still providing quick access to the contents of the storage unit. The storage unit provides high security against unauthorized use, i.e., anti-theft or prevention of access by children, thereby protecting valuables and other items, such as firearms, from undesired access. Various degrees of security and optional fireproofing can be incorporated into the storage units of the invention. In its most preferable embodiments the storage unit is combined with furniture, such as beds, sofas, wall units, modular furniture, including bookcase/desk combinations, as well as other combinations which will be apparent to those skilled in the art.

2. Description of the Related Art

The need to safeguard personal property has existed almost as long as the idea of private ownership. Despite this longstanding desire to prevent theft and unauthorized access, the safety of personal possessions remains of great concern to the population.

Attempts at providing storage space underneath a bedstead date to at least as early as 1874 as disclosed in U.S. Pat. No. 152,357 to French. In that disclosure, a bed-bottom (i.e., a support for the bed-springs or mattress and a dust cover for the draws below) is provided extending between the headboard and the footboard. A center rail or brace and transverse walls or guides to support drawers which open but from one side of the bed are provided. The transverse wall or guide above alluded to may be hollow or of box form, with covers on top, which can only be opened by removing the bed-bottom. Such a box would thus form a secret compartment where valuables could be stored and locked. The disadvantages of this disclosure is that access to the box or secret compartment required major disassembly of the bed including box spring or mattress and bed-bottom. Furthermore, the wood material used to construct the bed bottom neither provides a theft-resistant nor fireproof construction.

However, as late as the disclosure in U.S. Pat. No. 2,462,524 in 1949 to Mattedi, the art continued to utilize wooden materials of the type disclosed by French in 1874.

Even the advent of new materials for beds, i.e., waterbeds, which are plastic bladders filled with water, usually mounted on a pedestal, did not change the way the art regarded the possible utilization of storage space beneath the bed. U.S. Pat. No. 4,613,999 issued to Franco et al. in 1986; U.S. Pat. No. 4,110,854, issued to Sjolie in 1978, U.S. Pat. No. 4,807,315, issued to Wachenheim in 1989; and U.S. Pat. No. 4,888,838 issued to Pelski in 1989 each disclose waterbeds with drawers in the pedestals beneath the water filled plastic bladder or mattress. The Franco, Sjolie and Wachenheim disclosures typically utilized wooden members as the structural materials of the pedestal and drawer and provided no secure container and in such respects are similar to the Mattedi design.

Wachenheim, in a manner similar to French, utilized his pedestal to hide a conventional safe, i.e., formed a cavity beneath the water filled bladder which cavity was concealed by a removable panel. Although an improvement over French's disclosure, the security arrangement of Wachenheim relies upon two concepts, i.e., that the overlying waterbed mattress covers and protects the safe, and because of its weight, anchors the safe, and that the removable panel conceals the cavity in which the safe is placed. Unfortunately, waterbed mattresses are easily emptied by puncturing the waterfilled bladder with any sharp object, thereby exposing and de-anchoring the safe. The secrecy of a hidden cavity becomes questionable when such waterbed pedestals are mass produced, mass marketed and/or advertised as containing a hidden compartment. Thus, the art still has not provided a secure storage unit with ready accessibility of its contents, for example, in an emergency situation.

Even though metal has been utilized in bed furniture, e.g., bed frames as disclosed in U.S. Pat. No. 3,745,596 to Copeland since at least as early as 1973, to date the art has merely attached a box to such a metal frame in an attempt to secure the contents of the box. Note U.S. Pat. Nos. 4,788,838; 4,869,449; and 5,056,342. These units are unsightly and do not otherwise conform with the general lines or design of the furniture to which they are attached. Furthermore, the degree of security is only slightly more than having the same box unmounted and is less than having the box securely mounted to a sturdy support, e.g., wall or a floor. Accordingly, the prior art still has not yet satisfied the desire of the population to provide a safe and secure container which can be readily accessed.

The disclosures of each of the foregoing U.S. patents are herein incorporated by reference in their entirety.

OBJECTS OF THE INVENTION

It is thus an object of the invention to provide a secure container which deters and delays unauthorized or undesired access to the contents thereof.

It is a further object of the invention to provide such a furniture unit which accommodates a container with a degree of optional fireproofing.

It is still a further object to provide a secure container which will permit rapid, authorized access to the contents of the container, with or without a key.

It is still a further object of the invention to combine a secure container which can be incorporated into a unit of furniture, and in a particularly preferred embodiment, may be incorporated into one of a number of units of furniture, i.e., modular units.

It is still a further object of the invention to incorporate a secure container into beds (conventional or waterbeds), sofas, futon-frames, desks, bookcases, wall units, storage racks and other similar furniture which will become more apparent to those skilled in the art in light of the instant disclosure.

SUMMARY OF THE INVENTION

In one embodiment, the invention is directed to a secure container comprising:

a steel frame comprising posts, lintels and sills formed into an integral unit;

said frame being shaped and sized to house at least one secure container;

an optional drawer being slidable on guides fitted into said frame;

a secure container formed of sides, top, back and bottom formed into an integral box with an open-front located on any face of the container, a door lockable to secure the open front of said secure container, said secure container being fittable into said frame and means to secure said secure container in place in said frame.

In another embodiment, the invention is a secure container comprising an integrally formed frame of steel; a portion of said frame housing a safe; said safe being lockable to said frame, said frame including means to house at least one member selected from the group consisting of shelves, drawers and storage compartments.

The invention also includes an arrangement of modular furniture units; each of said modular units comprising an integral framework and a secured container positioned within said framework, at least one of said modular furniture units also include, a mattress supported by said framework.

A secure container for a modular unit of furniture, said secure container comprising a closed box of steel having an open front; said open front being closeable by a main access door, said main access door optionally containing a quick access door is also disclosed.

DETAILED DESCRIPTION OF THE PREFERRED EMBODIMENTS

The problem of crime, especially crime against property, e.g., theft, remains of continuing concern to the population.

Not only are apartment dwellers and homeowners the victims of theft, but also students at colleges and university, the military and others living in dormitory-like conditions.

Student and property security is one of the major issues confronting colleges and universities today. The December 1993 issue of *Security Sales* reports:

> According to the FBI's 1991 Uniform Crime Report surveying 436 campuses, there were 131,126 college campus property crimes . . . . Of the 11,000 students who answered the query, 37 percent had been victimized by crime in the past 4 years.

Because of the schedule of college and military life, dormitories and barracks are frequently unoccupied. Moreover, the basic furniture in dormitories and barracks most always includes a bed of some type.

Among the general population living in apartments, condominiums and other family dwellings, most unauthorized entries occur at night when the occupant of the dwelling is in bed. It would thus be most convenient for the occupant to readily obtain a weapon to be used for self-defense, such as a firearm. By contrast, unauthorized access when the property is unattended or when the dwelling is occupied by minor children is most desirable, especially where firearms are stored. Ordinary gun cabinets, used to display firearms are less secure and not always readily accessible from the bedroom. The so-called gun safes or vaults heretofore available usually are incongruous to a bedroom environment.

Thus, it is desirable for homeowners and others to have ready access to a secure container which is adjacent to the bed in which they sleep but is secure enough to deny ready access to unauthorized persons.

These desires can be satisfied by the invention described herein.

It is to be understood that throughout the figures of drawing that like elements are denoted by like numerals (unless otherwise designated for emphasis). Although the following disclosure is directed to a description of modular furniture, it is not limiting but merely illustrative of the invention.

Figure 1:
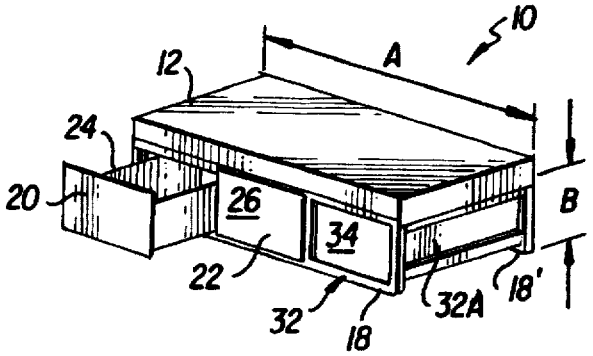
FIG. 1 is a perspective view of a modular base for a single-size bed having incorporated therein a storage unit and secure container according to the invention.

As schematically illustrated in FIG. 1 is shown a bed frame 10 preferably formed of welded, tubular steel. Bed frame 10 supports a mattress 12 which can be of conventional construction and used with or without a box spring (not shown) or foam.

Bed frame 10 is formed from a series of posts 14, 14', 14", etc. (FIG. 3) which are interconnected by headers 16, 16' (FIG. 7) and sills 18, 18' etc. (FIG. 1) to form a box-like frame. Preferably each of the posts, headers and sills are formed of fully weldable tubular steel which are welded into a integral structure. Although other methods of connecting the posts, headers and sills to form a frame can be utilized, such as nuts and bolts, screws, or rivets, welding of the components is preferable to prevent disassembly of the structure. Bed frame 10 may be finished with any suitable coating, such as an industrial enamel finish to resist blemishes and provide ease of maintenance. Colors can be selected to match room decor and the drawer fronts 20, 22 (FIG. 1) which preferably can be made of a durable finished material, such as solid wood or a thermally-fused, high pressure melamine resin laminate which can be made to match or contrast therewith.

The drawers 24, 26 (FIG. 1); 28, 30 (FIG. 5) can be of any convenient size and shape. In a typical single size bed, which has typical dimensions A (FIG. 1) of 77 inches by B (FIG. 1) of 17 and ½ inches, two drawers 22 inches wide by 11 and ½ inches high by 37 inches deep can be easily accommodated. Although drawers 24 and 26 have been described in connection with this single-size bed, it is to be expressly understood that one, or all, of the drawers disclosed herein can be substituted with a secure container or safe.

Figure 17:
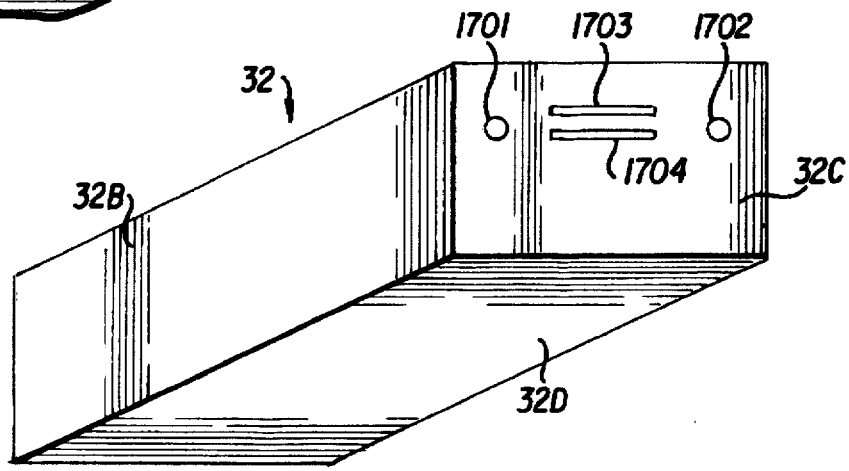
FIG. 17 is a rear perspective view of the secure container of the invention illustrating the rear, bottom and another side of the container.

A secure container, such as a storage safe 32 (FIG. 1) having a door 34, side 32A, 32B (FIG. 17), a top 1032A (FIG. 10), a back 32C and a bottom 32D (FIG. 17), of dimensions 22 inches wide, 13 and ½ inches high and 36 inches deep, will be readily accommodated. This size was selected as typical of a storage requirement of six cubic feet which will accommodate a personal computer and other valuables. Storage safe 32 is typically manufactured of plate steel of 3/16 inch thickness for the sides, top, bottom and back and ⅜ inch thickness for the door. The door 34 preferably is recessed and mounted on a steel hinge with bronze bushing inserts or ball bearings for increased life and reduced maintenance. Preferably, the hinge is oriented to permit ease of access. However, ease of access may vary depending on the position in which the safe 32 is located in bed frame 10, the position of other furniture, walls, floor electrical outlets, etc. Preferably the hinge is located at the lower portion of the safe opening or at either the left- or right-hand walls of the safe. Rarely would a top hinge mounted door be desirable. The safe door 34 preferably should be self adjusting. Any suitable fireproofing material could be incorporated onto the inside of the walls and/or the door of the safe to delay damage by fire. The type and amount of fireproofing material would depend on the fireproof rating desired. The fireproofing material could be suitable covered, e.g., by paint, carpeting, etc. to impart a pleasing appearance to the interior of the safe. However, unless very valuable materials, such as securities, currency, etc. are to be stored in the safe 32, fireproofing can be eliminated to avoid loss of storage capacity caused by the presence of the fireproofing material and any covering thereon.

Preferably, safe 32 is designed so that it can be removed from bed frame 10 and replaced by a conventional drawer, such as 24, 26 (FIG. 1). Such a design feature permits safe 32 to become a modular unit, lending itself to separate sale or lease to persons utilizing the basic modular furniture components of the invention.

Figure 2:
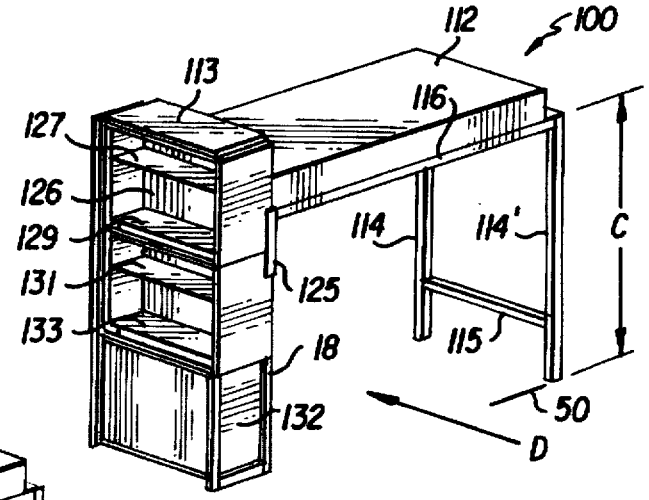
FIG. 2 is a perspective view of an alternative modular unit incorporating both a single size bed and a shelving unit with the secure container according to the invention being contained in the shelving unit portion of the modular unit.
Figure 3:
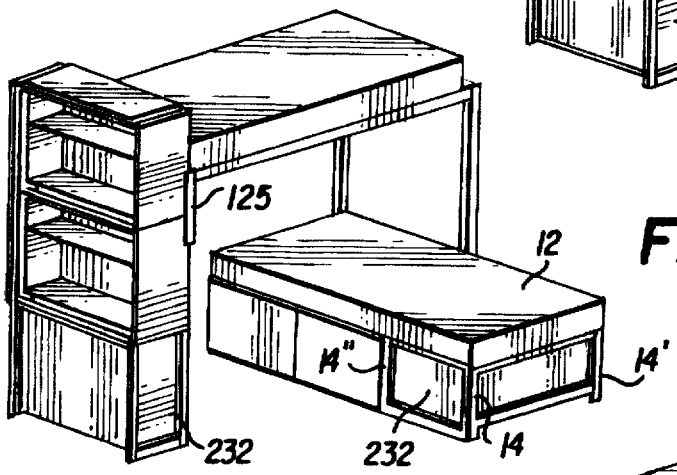
FIG. 3 is a perspective view of a coordinated modular base of FIG. 1 and the alternative modular unit of FIG. 2.
Figure 4:
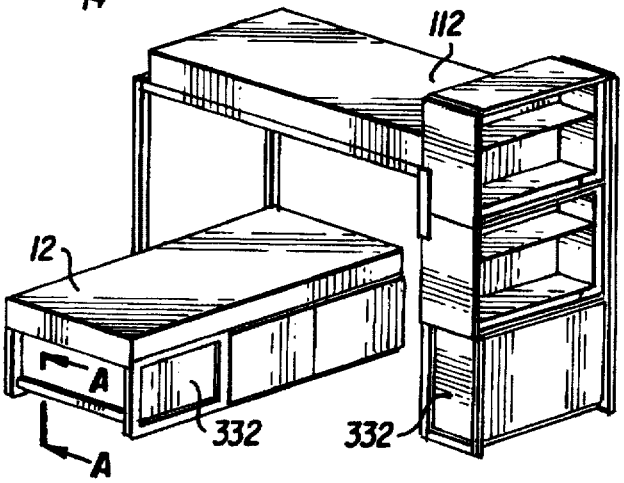
FIG. 4 is a perspective view of an alternative (mirror-image) coordination of the modular base and alternative modular unit of FIG. 3.
Figure 5:
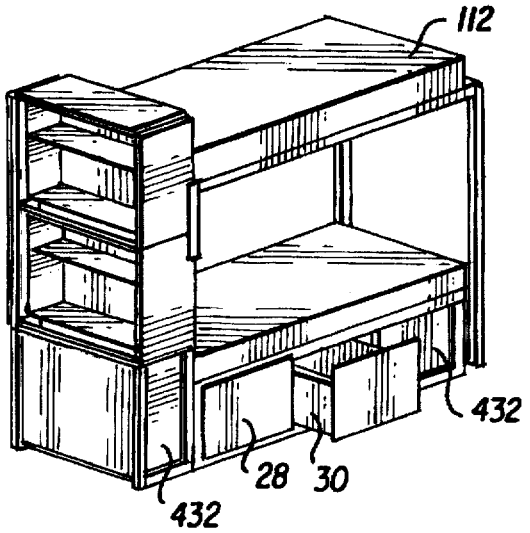
FIG. 5 is a perspective view of a still further coordination of the modular base of FIG. 1 and the alternative modular unit of FIG. 2 in the so-called "bunk bed" configuration.
Figure 6:
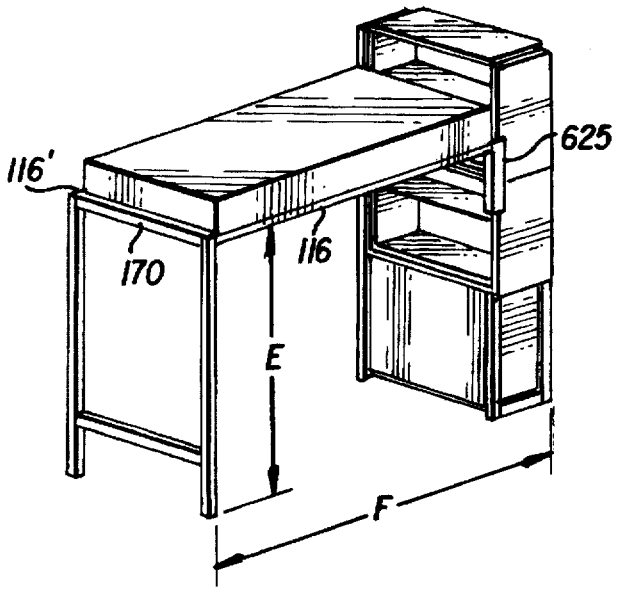
FIG. 6 is perspective view of a still further alternative modular unit.
Figure 4A:
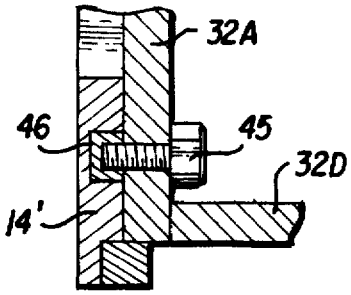
FIG. 4A is a schematic view along line A—A of FIG. 4.

Turning now to FIG. 2 is an alternative modular unit 100. In this instance, legs 114, 114' support transverse lintels 116 (FIG. 2), 116' (FIG. 6). Leg support 115 spans between legs 114, 114' to join and space them to form a strong system for supporting mattress 112 and its occupant (not shown). Sufficient space C (typically 61 inches) is provided between floor 50 and transverse lintels 116, 116' to permit nesting of the modular units of FIG. 1 as illustrated in FIG. 3, or in other orientations, such as the right-hand arrangement of FIG. 4, or in the "bunk-bed" configuration of FIG. 5. Alternatively, a study/living area can be provided in space D, formed between legs 114, 114', lintels 116, 16' and shelving unit/bookcase 113. Although individual shelves 117, 119, 121, 123 are illustrated in an open configuration, they may be individually or jointly closed by glass, wooden or melamine resin doors to match or contrast with the room decor on the doors 24, 26 of FIG. 1. The framework of shelving unit/bookcase 113 is preferably made of the same kind of welded tubular steel utilized in FIG. 1, because a secure container 132 is designed to be incorporated into the base of shelving unit/bookcase 113. In all respects, secure container 132 is similar to the construction of safe 32 of FIG. 1. When assembled, the modular base 10 of FIG. 1 and the alternative modular unit 100 of FIG. 2 would each contain a separate secure container 232 (FIG. 3); 332 (FIG. 4); or 432 (FIG. 5).

Although the bookcase can be attached, via its rear wall 126 to legs 114, 114' via lintels 116 (116' not being shown in FIG. 2), the modular nature of the construction also permits attachment to the face of the shelving unit/bookcase as illustrated in FIG. 6. In the configuration of FIG. 6, the overall length F remains at 97 and ½ inches. It is to be expressly understood that the dimensions disclosed herein are not critical but are merely illustrative of the best mode of carrying out the invention now known to the inventors. Other dimensions will be readily apparent to those having ordinary skill in the art.

Furthermore, the drawers 24, 26 (FIG. 1) can be designed and supported, by wedges placed along top headers 16, 16' permitting modular unit 10 to be used as the shelving unit/bookcase unit 113. Intermediate dividers 117, 121 (FIG. 2) can be inserted into drawers 24, 26 (FIG. 1) when in the FIG. 2 orientation. The drawers 24, 26 can be captured by elements 125 (FIGS. 2–3), 625 (FIG. 6) when oriented into the shelving unit/bookcase orientation of FIG. 2 in order to prevent them from opening while in the vertical position. The partially displaced drawer 81 (FIG. 8) can be optionally constructed to open when the modular furniture is in vertical orientation. However, normally elements 125, 625, which are typically formed of angle iron which can be fastened into sills 18, 18' and welded to transverse lintels (116 in FIG. 2) to connect legs 114, 114' to the upright modular unit 100 maintain the drawers in closed position as shown in FIGS. 2–6.

A mattress platform 1077 (shown partically cut away in FIG. 10) formed of wood, melamine, or steel, used to support mattress 12 on modular unit 10 of FIG. 1 can be omitted or removed when used in the orientation of FIG. 2. When the drawers 24, 26 are designed to be lockable, it is preferable for the mattress platform to be of steel permanently attached to bed frame 10 e.g. as by welding. The provision of a mattress platform 1077 (FIG. 10), which fully supports the mattress, lengthens mattress life.

If it is anticipated that the safe 32 will be used to house computer, stereo or other electrical equipment during use, electrical connections may be placed through the walls of safe 32. Alternatively, small openings 1701, 1702 may be placed in the safe walls in order to permit access by power, keyboard, printer, electric, computer or speaker cables. Slits 1703, 1704 may be included to act as vents for cooling of the interior of the safe 32. Thus, computer, stereo and other electrical equipment can be operated from within the locked safe 32 without the need for accessing the interior of the safe 32.

Figure 7:
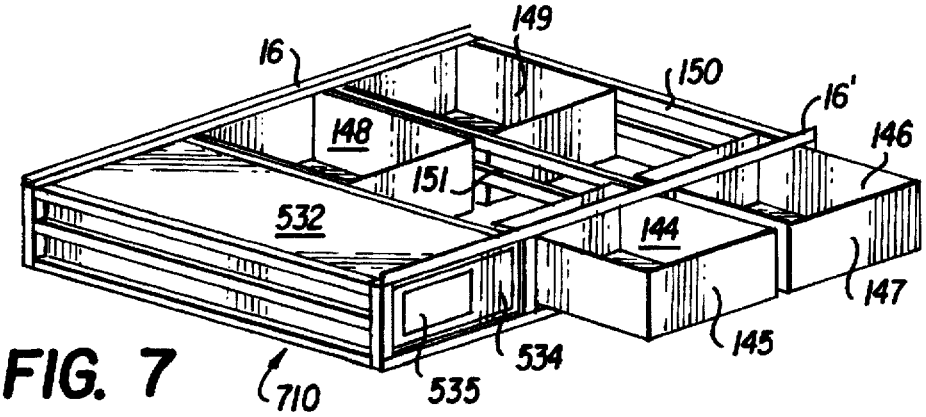
FIG. 7 is a perspective cross-sectional view similar to the modular unit of FIG. 1, enlarged to queen-sized bed configuration to show detail.

In the queen-size bed configuration of FIG. 7, it can readily be seen that the dimensions will readily accommodate two drawers 144, 146 openable on one side of the bed approximately 30 inches deep by 22 inches wide by 11 inches high and a second set of drawers 148, 149 opposed to drawers 144, 146 and openable from the opposite side of the double bed. Although each of drawers 144, 146, 148 and 149, like the other drawers in throughout the Figures may be made lockable, the security of the modular furniture relies upon safe 532. The drawers can be made of any suitable materials, such as steel, wood, melamine or other resin, or composites. The drawer fronts 145, 147 are independent of the drawer box allowing ready replacement of the drawer fronts 145, 147 as necessary without the need to replace the entire drawers. The drawers can be made to lock with a combination, key or padlock. Although the embodiment of FIG. 7 has been described in connection with a queen-size bed, its description is applicable to other bed sizes such as double-size, king-size, etc.

Drawer glides 150, 151 (FIG. 7) are preferably ball bearing and are welded to the bed frame 10 or 710 to prevent loosening during operation. Where the safe is anticipated to be placed, angle iron can be welded to bed frame 10 to form a guide, receptacle, and cage for the safe 32 or 532. To secure safe 32 to the bed frame 10 (or 532 to 710), a locking bolt 45 may be engaged with a blind nut 46 welded on the bed frame 10 or 710, so as to not be accessible from outside the safe. Other means may be used to secure the safe 532 to bed frame 710 and 32 to 10, such as welding or locking. Because safe 532 and 32 are in a cage of steel, unauthorized removal of the safe from the modular furniture is inhibited. Additionally, means such as anchor bolts (not shown) passing through safe 532 and or bed frame 710 beneath or behind safe 532 may be used to anchor the bed frame 710 and/or safe to the floor and/or wall, respectively. Similarly, additional means can be used for safe 32 and frame 10.

The safe locking mechanism can be of a variety of configurations.

Figure 9:
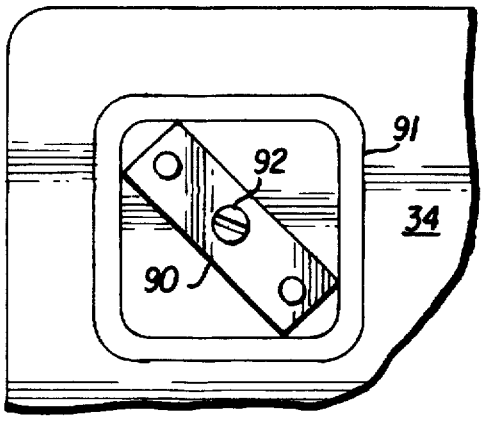
FIG. 9 is an enlarged portion of a door of a secure container showing particulars of one lock configuration.

It can be of a simple key operated tumbler lock design, a key or combination padlock with shackle. The lock can be either key removable or key retaining in the unlocked position. The latter will not allow the safe to be locked without use of the key. When using a padlock 90 (FIG. 9) with shackle (not shown), a fixture 91, approximately two and one half inches by two and one half inches by ¼ inch wall thickness, preferable in the form of square steel tubing is welded to the safe door 34 around the padlock 90 leaving exposed the key opening 92. Such tubing fixture 91 provides addition protection of the padlock 90 from physical attack, while means, such as a screw (not shown), retains and aligns the padlock 90 for proper lock operation. A preferred padlock is that sold under the registered trademark ABLOY DISKLOCK®, although other padlocks may be used. The preferred padlock has nearly two billion possible key combinations and is virtually pickproof due to rotating disk construction. However, master keying is available for added convenience. The standard steel components with drill resistant inserts is an additional feature of the preferred padlock.

Figure 16:
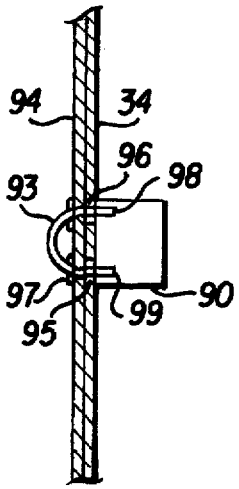
FIG. 16 is a schematic top view of a shackle and lock body in operative position to "lock" the safe door.

As shown in FIG. 16 shackle 93 may be welded (97) to the upper flange 94 of safe 32 so as to project through openings 95, 96 in safe door 34. Lock body 90 is separable from shackle 93. (In FIG. 9 the fixture 91 is omitted in order not to obscure detail.) The ends 98, 99 of shackle 91 may be beveled to self-align door 34.

Other locking mechanisms will be readily apparent to those skilled in the art such as standard mechanical combination locks or electronic locks, either of which may be provided with or without bolt works. For example, an S&G® electronic lock may be employed. Thus, various degrees of security from a typical school locker style to sophisticated locking mechanisms can be employed.

Figure 8:
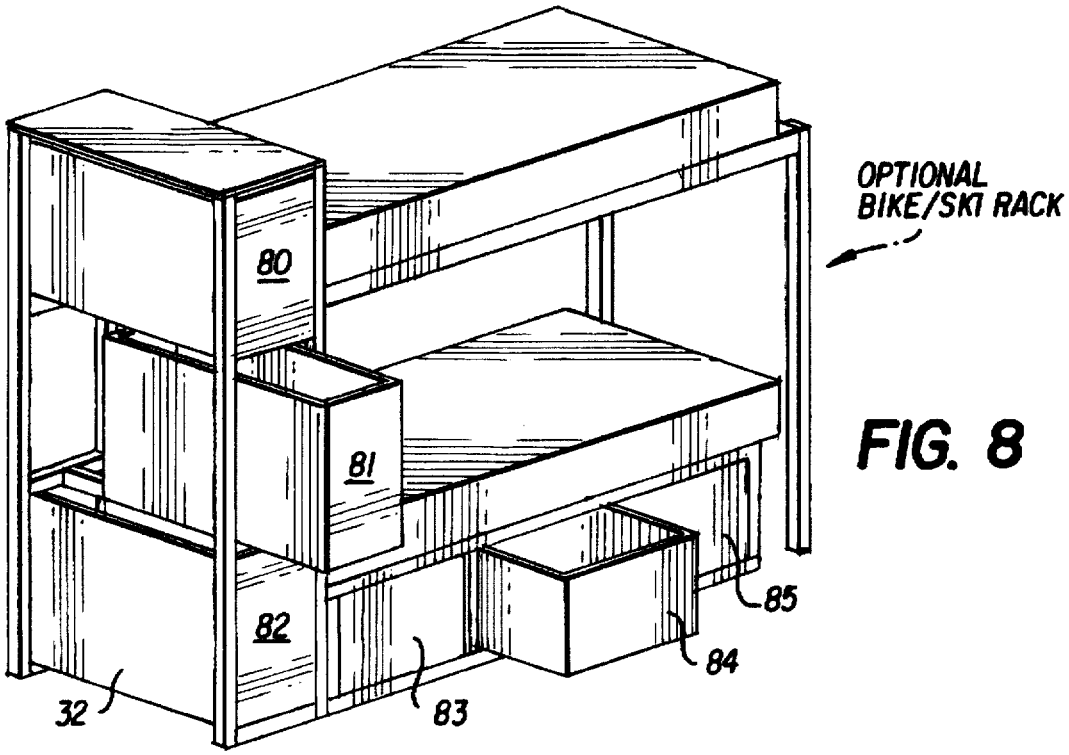
FIG. 8 is a perspective view of a "bunk-bed" configuration enlarged to show detail, including an optional bike, ski or large item lockable rack.

Additionally, the safe 32 or safe door 34 (FIG. 1) can be equipped with monitoring devices (not shown) to activate silent or audible alarms or alert security personnel. Although the safe 32 can be concealed behind a conventional drawer front 20, 22 so as to match the remainder of the modular unit, the storage container of the invention does not rely on concealment to safeguard its contents. Rather it is the aesthetic appearance of the overall modular, or overall assembled modular units, that is affected by utilizing drawer fronts 20, 22 over safe door 34. As shown in FIG. 8, the assembled "bunk-bed" configuration will present a pleasing appearance when each of drawer fronts 80, 81, 82, 83, 84, and 85 each match the others in composition, color, etc. even though fronts 82 and 83 each conceal a safe 32.

In a further embodiment of the safe 32 of FIG. 1 is the embodiment of FIG. 7 designed to fit a queen- (or double- or king-size) size bed. Here, (described in connection with a queen-size bed) safe 532, of typical dimensions of sixty inches long by twenty-two inches wide by ten inches high can house the so-called long guns, i.e., rifles and shotguns, as well as handguns. Because the safe 532 may have relatively long items, and smaller items, such as a handgun, the safe door can be modified into a quick access door 535 and a main access door 534. Main access door 534 is similarly constructed and mounted to safe 532 as door 34 is mount to safe 32 of FIG. 1. Quick access door 535 is independently openable from main access door 534 and may be designed as a mini-safe, separate and apart from the contents of safe 532. For example, it may be sized to hold only jewelry and/or currency, or a single handgun. The handgun can be mounted to the inside of quick access door 535 so as to be readily accessible when quick access door 535 swings open. Preferably the handgun is retained on the inside of quick access door 535 by clips (not shown) permitting ready accessibility when quick access door 535 is opened. It is preferable to provide a punch key electronic access or magnetic key or key or proximity card access to activate quick access door 535 so that it may be hurriedly opened, although the same or more conventional means may be provided for opening main access door 534. Proximity, magnetic swipe card or card reader technology are alternatives for opening the quick access door 535.

From the foregoing description, it is clear that arrangements of a secure container and/or storage units within the framework of the invention can take many forms, depending on desired use of the unit, desired ratio of secure containers to storage units, desired size of safe, etc.

It will be readily apparent to those skilled in the art, upon reading this disclosure, to create other arrangements without departing from the spirit and scope of the invention.

Figure 10:
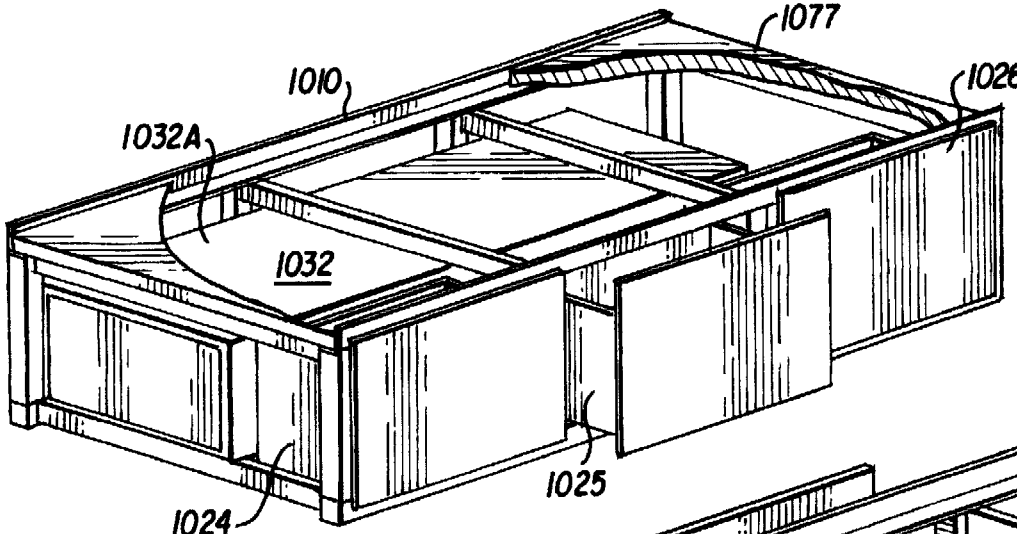
FIG. 10 is a perspective view of alternative arrangement of drawers and safe within a modular unit.
Figure 11:
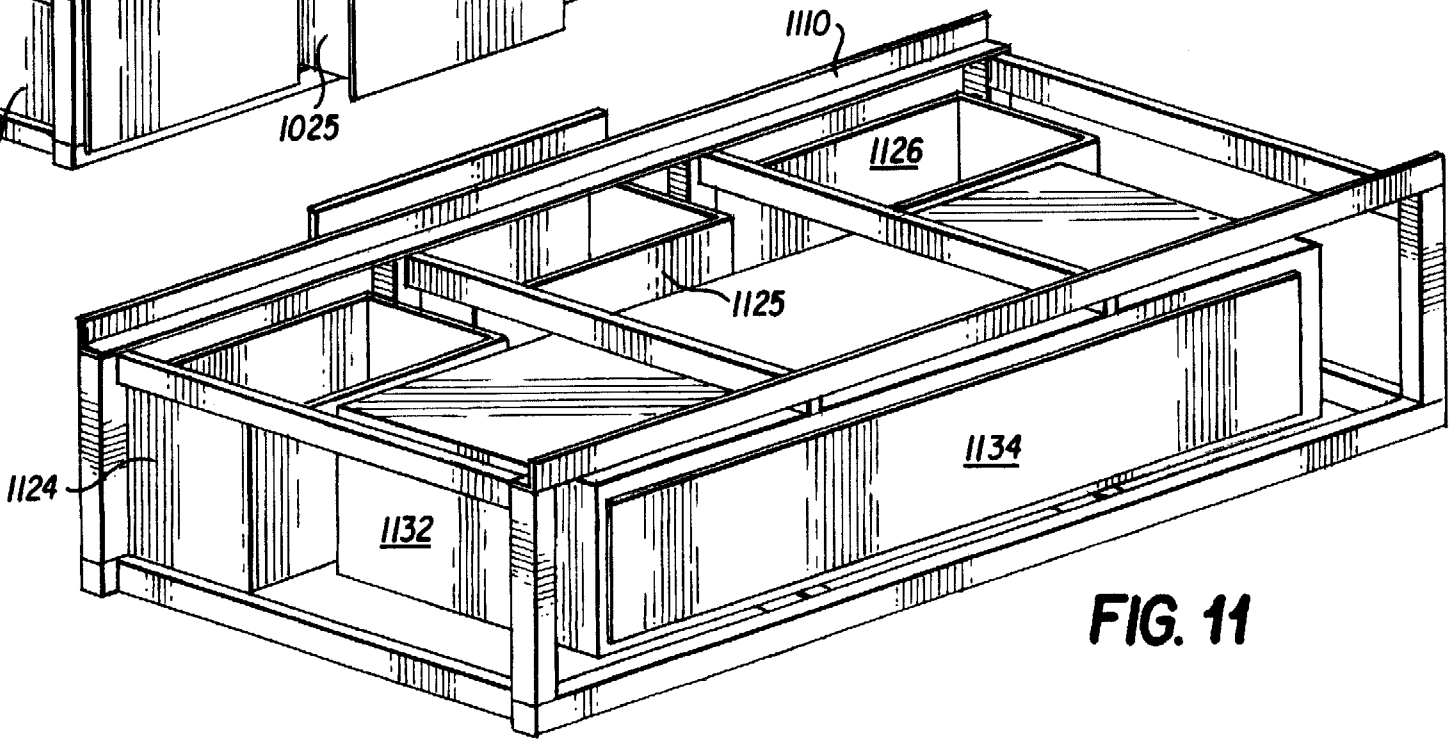
FIG. 11 is a perspective view of a still further alternative arrangement of a modular unit.

As shown in FIGS. 10 and 11 are two alternative arrangements of secure container and storage units. As seen in FIG. 10, safe 1032 is arranged to extend generally parallel to framework 1010. A series of storage units 1024, 1025, 1026 are arranged so as to be slidable in a direction generally transverse to the longer axis of framework 1010 and safe 1032. As with all the drawers disclosed throughout the various embodiments of the invention, drawers 1024, 1025, 1026 may be mounted on drawer glides (not shown in FIG. 10 but similar to drawer glides 150, 151 shown in FIG. 7) which drawer glides are attached to framework 1010 by welding, bolting, or otherwise fastening such that the drawer glides are mounted at a slight incline descending toward the interior of framework 1010. Because of this mounting orientation, the drawers (in all such embodiments where this feature is employed) will tend to be self-closing due to the force of gravity. Of course, other means (not shown) can be employed to assist in this self-closing, e.g., springs. It will be readily understood that sufficient clearance is necessary between the top front of the drawer and the header of the framework to permit the drawer to open and close without binding in this embodiment.

FIG. 11 illustrates a further embodiment in arrangement of safe 1132 and drawers 1124, 1125, 1126 within a metal framework 1110. In such an arrangement, safe door 1134 opens on the opposed side of framework 1110 from the opening of drawers 1124, 1125, 1126.

Through all the embodiments disclosed herein, whether containing drawers or other types of storage units, the drawers as depicted are only for illustrative purposes and it is within the scope of the invention to have further subdivisions of the drawers, shelves or smaller storage compartments within any of the drawers disclosed herein.

Figure 12:
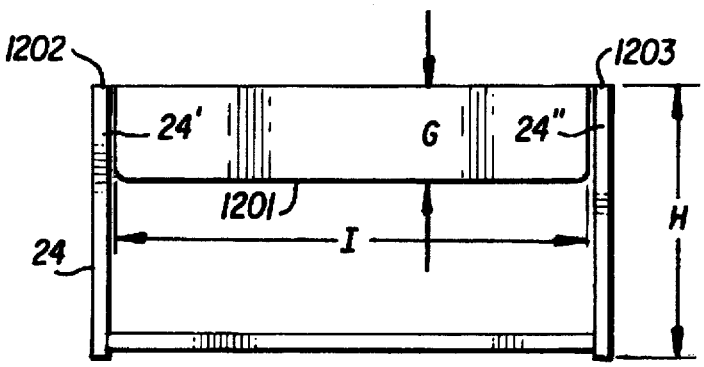
FIG. 12 is a front, partially-sectioned view of a drawer useable in the invention.
Figure 13:
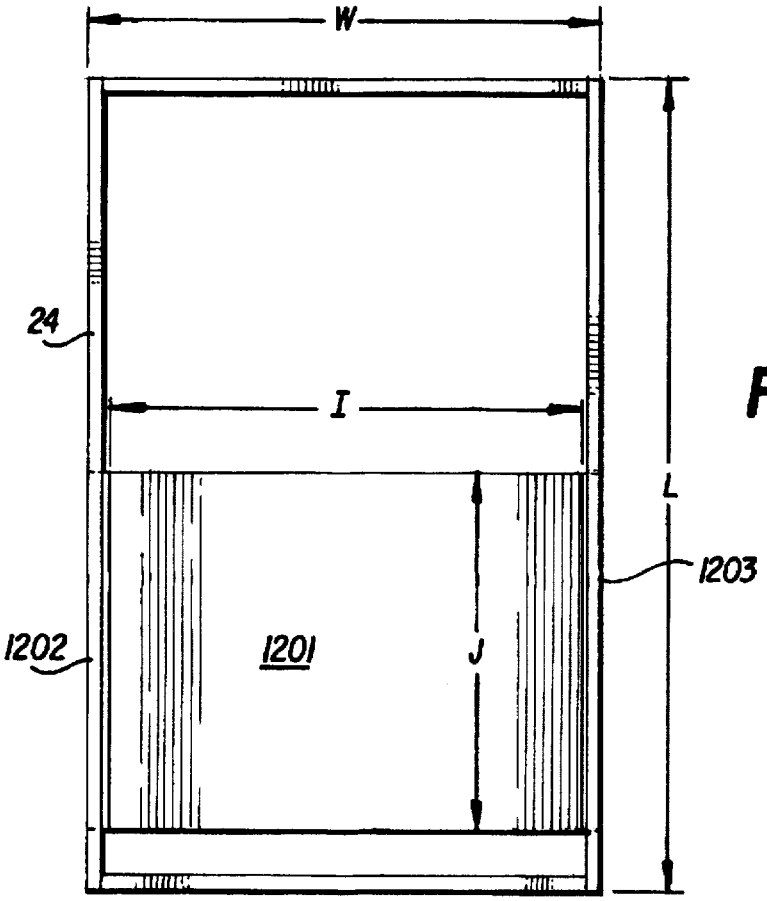
FIG. 13 is a top view of the drawer of FIG. 12.

One desirable way to facilitate further subdivision of a single drawer is by the use of inserts, formed of any suitable material such as wood, plastics, composites, etc. Particularly preferred are plastics. In the embodiment of FIG. 12, in which 24 depicts a drawer, a tray 1201 formed out of plastic, having flanges 1202, 1203, is placed such that flanges rest upon the upper ends 24', 24" of drawer 24. Tray 1201 may be of any suitable depth, for example distance G may be four to eight inches when overall drawer height H is eleven and one-half inches, although it may extend lesser or greater than such amount.

Tray 1201 may extend completely or partially over the total length L of drawer 24. For a drawer 24, typically having a length L of thirty-six inches and a width of twenty-two inches, the tray 1201 could have a typical dimension I of twenty and one-quarter inches by sixteen inches (dimension J). In a further variation of tray 1201, the tray may be made waterproof and insulated, for example, by means of a lining or coating of a foamed plastic so as to act as an ice bucket. In such an other embodiment, the tray 1201 may also include a top (not shown) to close the ice bucket.

Figure 14:
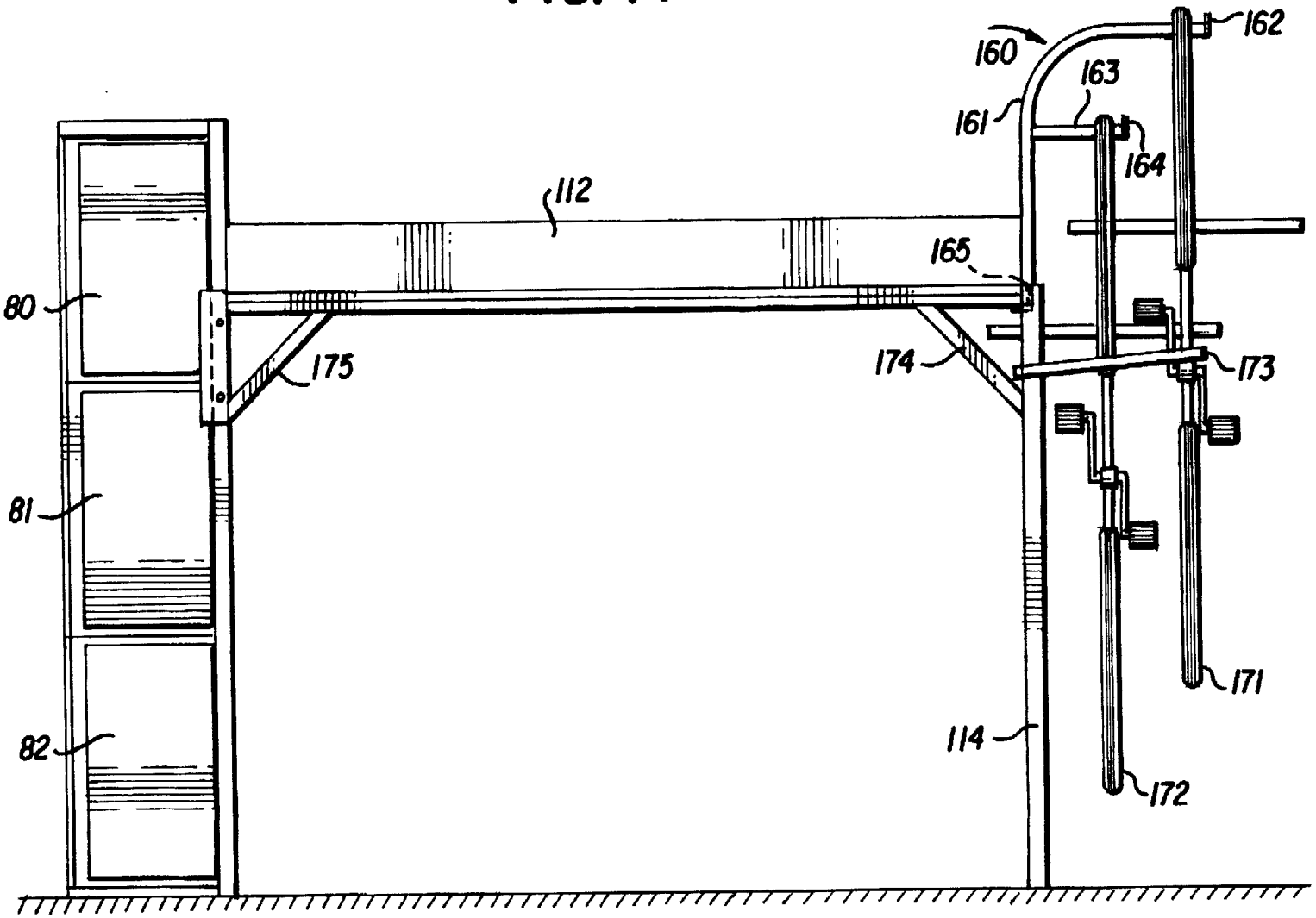
FIG. 14 is a side view of part of the embodiment shown in FIG. 8, illustrating an "optional bike rack".

As shown in FIG. 14, the embodiments of FIG. 2 (or FIG. 8) are provided with an optional bicycle rack 160. Bicycle rack 160 is manufactured out of an arcuate steel member 161 having an end flange 162. One or more transverse members 163, each having their own end flange 164, may be welded or otherwise secured to arcuate member 161. The lower end of arcuate member 161 may be firmly secured at 165 to transverse member 170 (FIG. 6) (and/or lintels 116, 116') by bolting, welding, etc.

One or more bicycles 171, 172 may be hung on member 161, 163 and locked to legs 114 by any suitable means 173, such as a "bicycle lock", chain and padlock, etc. In any of the foregoing embodiments, gussets 174, 175 may be included to provide additional rigidity an strength.

Figure 15:
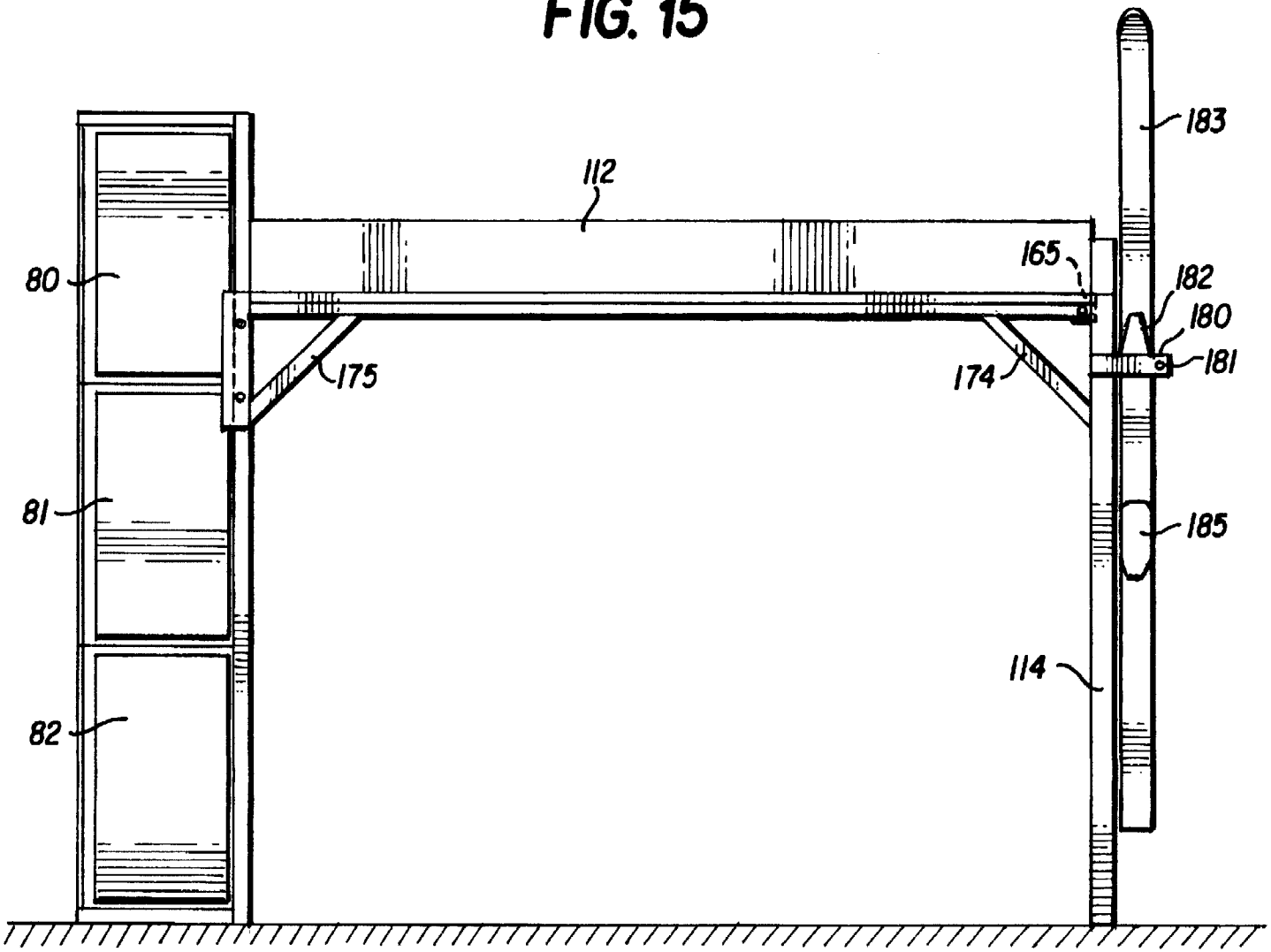
FIG. 15 is a side view of part of the embodiment shown in FIG. 8, illustrating an "optional ski rack".

In FIG. 15 is shown the optional ski rack. (Like numbers designate like elements between FIGS. 14–15.) A transverse yoke 180 formed of steel and defining a hole 181 for removing the shackle of a padlock (not shown) is securely fastened at 165. In use the toe binding 182 of each ski 183 is placed above yoke 180 and the shackle inserted through hole 180 securing the skis to the bed. The length of the skis and the presence of toe binding 182 and heel binding 185 make it impossible to slip the ski 183 out of yoke 180 because of interference with either the bindings and/or the floor or ceiling. More than one set of yokes 180 may be provided to retain other skis. If desired the ski/bicycle rack of embodiments shown in FIGS. 14 and 15 may be combined into a single embodiment.

Although the foregoing description has been disclosed in connection with twin- and queen-size beds, it is readily apparent to those skilled in the art that it may be used with many bed sizes including double- and king-size as well as the corresponding waterbed sizes. Other non-standard size beds may also be accommodated. Although disclosure has centered about modular bed furniture, it is readily apparent that the invention may be accommodated into other furniture including sofas, desks, bookcases, wall units, etc.

Where feasible, recycled components such as recycled steel and composite wood products are utilized to reduce environmental impact.

Thus, although the present invention has been described in detail with reference only to the presently-preferred embodiments, it will be apparent to those of ordinary skill in the art that various modifications may be made without deviating from the essence of the invention and all such modifications are intended to be covered by the appended claims.

We claim:

1. A storage unit comprising:

a steel frame comprising posts, lintels and sills formed into an integral unit;

said frame being shaped and sized to house at least one secure container;

at least one secure container defining a space, said secure container being formed of sides, top, back and bottom formed into an integral box having an open face, a door lockable to secure the open face of said secure container, said secure container being fittable into said frame and including means extending from said space into said steel frame to secure said secure container in place in said frame.

2. The storage unit of claim 1 wherein said frame is formed of tubular steel in which the posts, lintels, and sills are welded into said integral unit.

3. The storage unit of claim 1 wherein said sides, top, back and bottom of said secure container are formed of plate steel.

4. The storage unit of claim 1 wherein said door is formed of plate steel.

5. The storage unit of claim 1 wherein said means to secure said secure container in place comprise a blind nut welded to said frame and a bolt engageable with said nut, said bolt not being accessible from outside the space defined by said secure container.

6. The storage unit of claim 1 further including a mattress platform supported by said frame.

7. The storage unit of claim 1 wherein said open face of said at least one secure container is closable by a main access door, said main access door containing therein a quick access door.

8. The secure container of claim 7 wherein the quick access door opens to a compartment in said secure container other than the interior of said secure container.

9. The secure container of claim 7 wherein each of the quick access door and main access door have separate locking mechanisms.

10. The secure container of claim 9 wherein the locking mechanism on the quick access door is different from the locking mechanism on the main access door.

11. The combination of claim 1 wherein the door is lockable by a padlock having a shackle.

12. The combination of claim 11 wherein a fixture of steel is welded to said door about said padlock.

13. The combination of claim 1 wherein said secure container contains access ports to allow for passage of electrical conductors.

14. The combination of claim 1 wherein said secure container contains ventilating slits.

15. The combination of claim 1 further including at least one drawer slidable on guides fitted into said frame.

16. The combination of claim 1 further comprising a bicycle rack.

17. The combination of claim 1 further comprising a ski rack.

18. A modular furniture unit comprising the storage unit of claim 1 and further comprising means to support a mattress.

19. The storage unit of claim 1 wherein said steel frame is shaped to include means to house drawers.

20. The storage unit of claim 1 wherein said steel frame to include means to house shelves.

* * * * *